US008991229B1

(12) United States Patent
Cheng

(10) Patent No.: US 8,991,229 B1
(45) Date of Patent: Mar. 31, 2015

(54) TUBE BENDER

(71) Applicant: Chieh-Yu Cheng, Taichung (TW)

(72) Inventor: Chieh-Yu Cheng, Taichung (TW)

( * ) Notice: Subject to any disclaimer, the term of this patent is extended or adjusted under 35 U.S.C. 154(b) by 0 days.

(21) Appl. No.: 14/181,575

(22) Filed: Feb. 14, 2014

(30) Foreign Application Priority Data

Jan. 14, 2014 (TW) ..... 103200756 U

(51) Int. Cl.

| | |
|---|---|
| ***B21D 7/04*** | (2006.01) |
| ***B21D 7/024*** | (2006.01) |
| ***B21D 7/02*** | (2006.01) |
| ***B21D 7/025*** | (2006.01) |

(52) U.S. Cl.
CPC *B21D 7/024* (2013.01); *B21D 7/02* (2013.01); *B21D 7/025* (2013.01)
USPC ..... 72/149

(58) Field of Classification Search
CPC ..... B21D 7/024; B21D 7/025; B21D 7/02
USPC ..... 72/149, 151–153, 156–159, 217, 218, 72/219, 319, 320, 321
See application file for complete search history.

(56) References Cited

U.S. PATENT DOCUMENTS

| | | | | |
|---|---|---|---|---|
| 682,671 | A * | 9/1901 | Condon | 72/158 |
| 3,236,082 | A * | 2/1966 | Beck et al. | 72/149 |
| 3,336,779 | A * | 8/1967 | Schall | 72/217 |
| 3,785,190 | A * | 1/1974 | Schall et al. | 72/149 |
| 4,843,858 | A * | 7/1989 | Grimm et al. | 72/149 |

* cited by examiner

*Primary Examiner* — David B Jones

(57) ABSTRACT

A tube bender is provided. The rotatable member is pivoted to a pivot portion of a base and defines an inner space, and the rotatable member has a gear portion, a first arched groove and a holding portion. The gear portion archedly extends around the pivot portion. The first arched groove archedly extends around the pivot portion on an outer circumferential surface of the rotatable member, and the holding portion has a holding recess. The abutting assembly includes an abutting chunk assembled to the base and an arm member connected with the abutting chunk. A gear assembly includes a driving portion pivoted to the arm member and a gear connected and synchronously-movable with the driving portion. The gear engaged with the gear portion in the inner space.

11 Claims, 6 Drawing Sheets

TUBE BENDER

BACKGROUND OF THE INVENTION

1. Field of the Invention

The present invention relates to a bender, and particularly to a tube bender.

2. Description of the Prior Art

In conventional technical field, electric appliances, vehicles or motorcycles et al. are generally provided with various kinds of tubes. The tubes usually need to be bent according to various working environments for better arrangement thereto. As a result, various kinds of benders are always applied to assist the bending tasks. Some kinds of benders are disclosed, for example, in TW M441527, TW I356740, TW M417239, TW M377263 and TW M283695.

Either of the benders disclosed in TW M441527 and TW I356740 has defects of large size, complex structure, difficult operation and high cost. In addition, the benders disclosed in TW M441527 and TW I356740 can be applied only to tubes with a specific size. Moreover, when there are troubles with the bender, it is time-consuming to repair or replace the damaged part(s).

A bender disclosed in TW M417239, TW M377263 or TW M283695 has a small size and simple structure relative to that disclosed in TW M441527 or TW 1356740, and is hand-operable. However, during the bending of a tube, it requires great bending force, has poor production efficiency and poor production quality, and can cause considerable inaccuracy and high production cost.

The present invention is, therefore, arisen to obviate or at least mitigate the above mentioned disadvantages.

SUMMARY OF THE INVENTION

An object of the present invention is to provide a tube bender which can provide times of bending force and save efforts, and is simple in structure, easy to manufacture and assemble and of low production cost. Moreover, parts of the tube bender may be designed to be detachably assembled and can be replaced according to requirements, so that it has good compatibility and applicability, and it needs only to replace a single damaged part but not the whole of the tube bender, thus being convenient and economical.

To achieve the above and other objects, a tube bender includes a base, a rotatable member and an abutting assembly. The base has a pivot portion. The rotatable member is pivoted to the pivot portion and defines an inner space, and the rotatable member has a gear portion, a first arched groove and a holding portion. The gear portion archedly extends around the pivot portion and is located within the inner space. The first arched groove archedly extends around the pivot portion on an outer circumferential surface of the rotatable member, and the holding portion has a holding recess. As viewed in a radial direction of the rotatable member, an outmost radial position of the holding recess extends beyond an outmost radial position of the first arched groove. The abutting assembly includes an abutting chunk assembled to the base, and an arm member connected with the abutting chunk. The gear assembly includes a driving portion for being driven by a driving tool and includes a gear connected and synchronously-movable with the driving portion. The driving portion is pivoted to the arm member, and the gear engaged with the gear portion in the inner space.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
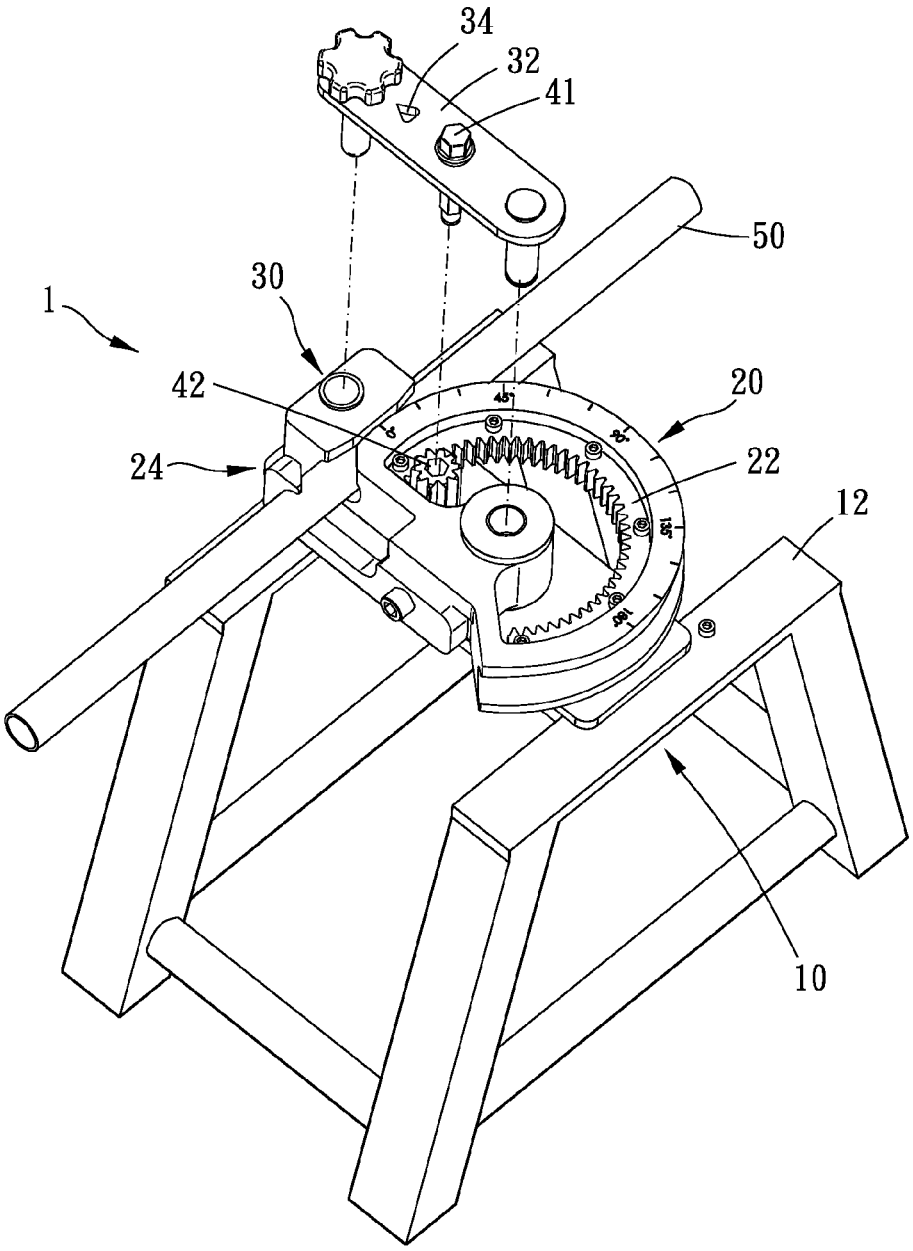
FIG. 1 is a view showing a tube bender according to a preferred embodiment of the present invention.
Figure 2:
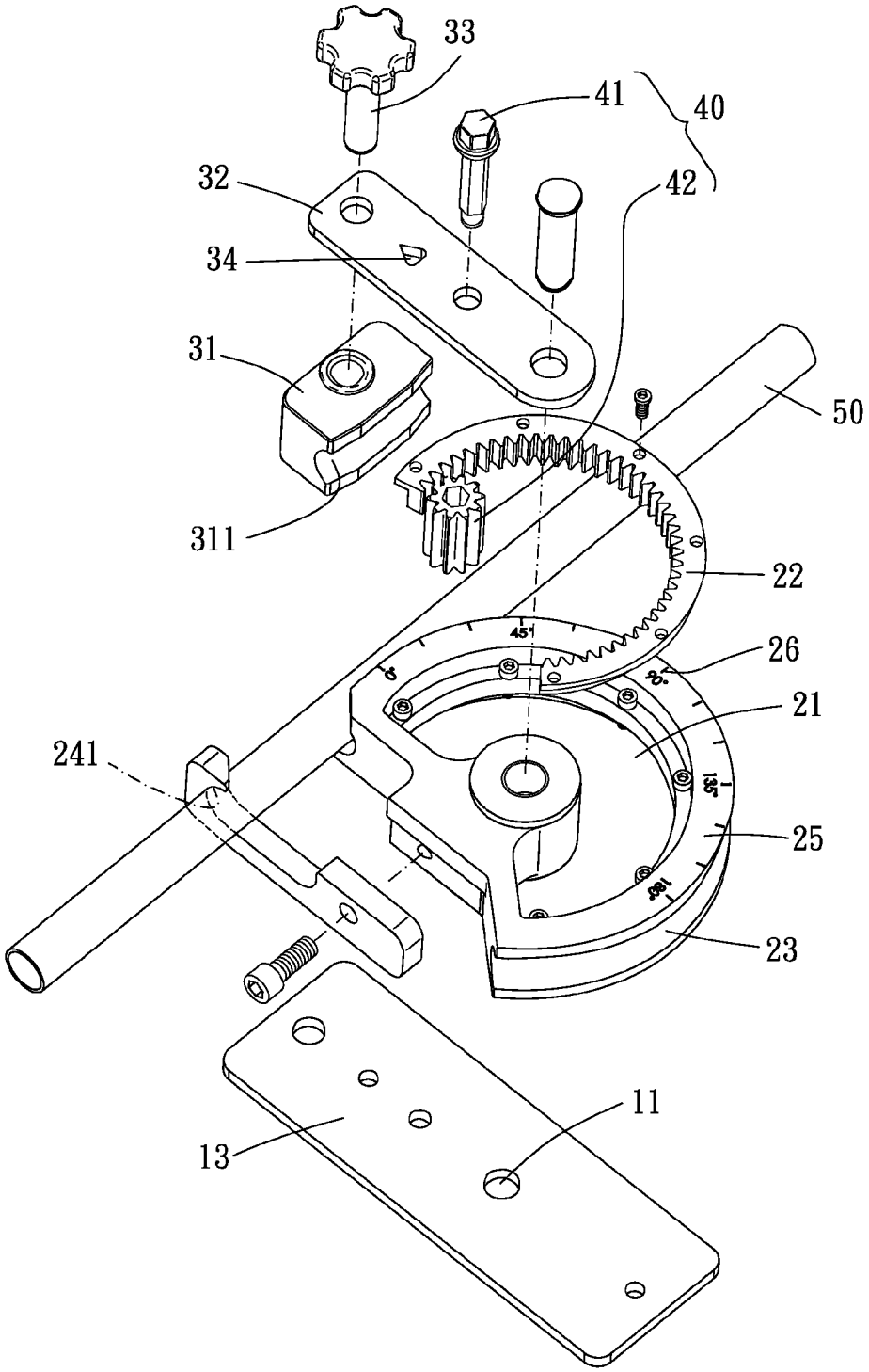
FIG. 2 is a partial breakdown drawing of a tube bender according to a preferred embodiment of the present invention.
Figure 3:
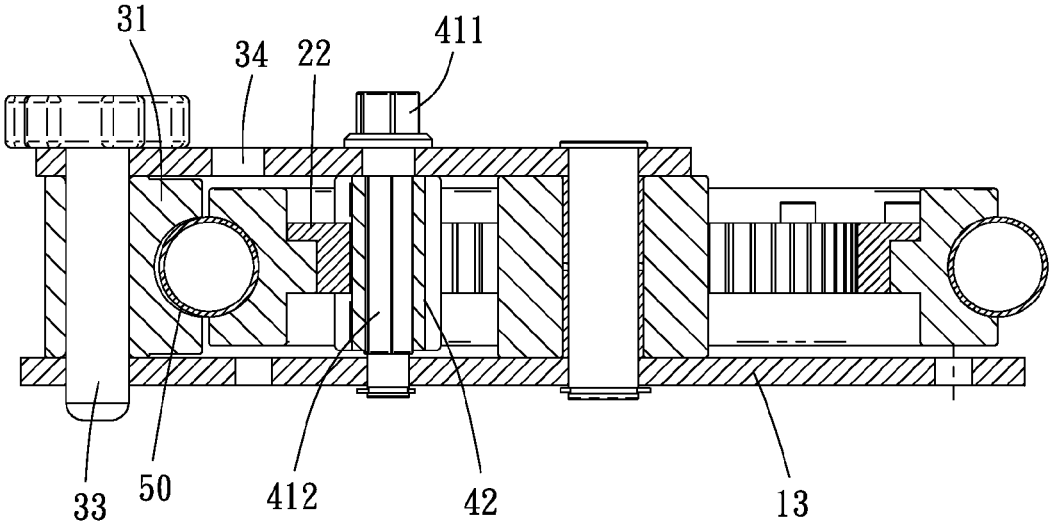
FIG. 3 is a partial cross-sectional view of a tube bender according to a preferred embodiment of the present invention.

As shown in FIGS. 1 to 3, a tube bender according to a preferred embodiment of the present invention is provided. The tube bender 1 includes a base 10, a rotatable member 20, an abutting assembly 30 and a gear assembly 40.

The base 10 has a pivot portion 11. In this embodiment, the base 10 includes a stand 12 and a plate member 13 mounted on the stand 12. The pivot portion 11 is a pivot hole formed on the plate member 13, and two fasteners fix the plate member 13 to the stand 12. It is noted that the plate member 13 is optionally provided or integrally formed as a part of the stand 12.

The rotatable member 20 is pivoted to the pivot portion 11 and defines an inner space 21, and the rotatable member 20 has a gear portion 22, a first arched groove 23 and a holding portion 24. The gear portion 22 archedly extends around the pivot portion 11 and is located within the inner space 21. The first arched groove 23 archedly extends around the pivot portion 11 on an outer circumferential surface of the rotatable member 20. The holding portion 24 has a holding recess 241. As viewed in a radial direction of the rotatable member 20, an outmost radial position of the holding recess 241 extends beyond an outmost radial position of the first arched groove 23 and the holding recess 241 and the first arched groove 23 form a holding aperture. As a result, the holding aperture is provided for disposing of a tube 50 to be bent therethrough. Specifically, the rotatable member 20 further includes a main body 25 which defines the inner space 21. The gear portion 22 is detachably assembled with the main body 25 so that the gear portion 22 can be replaced according to requirements (such as replaced with a gear having different number of teeth or archedly extending length, or replacing the damaged gear). Preferably, the rotatable member 20 is further provided with an angle reference portion 26 which may include, but is not limited to, marks of 0-180 degrees, for references of the bending angles of the tube 50. In this embodiment, the holding portion 24 is detachable. More specifically, the holding portion 24 is provided as a hooked arm having the holding recess 241. The holding portion 24 is fixed to the main body 25 via fasteners such as screws and by a side opposite to the gear portion 22. The holding portion 24 can be replaced according to requirements (such as replaced with having different an extending length and size of holding recess according to the size of a tube to be bent, or replacing the damaged holding portion).

The abutting assembly 30 includes an abutting chunk 31 mounted to the plate member 13 of the base 10 and an arm member 32 connected with the abutting chunk 31. The abutting chunk 31 has a second arched groove 311 corresponding to the first arched groove 23, and the second arched groove 311 and the first arched groove 23 are preferably extend oppositely. Specifically, the arm member 32 connects the pivot portion 11 and the abutting chunk 31, and the abutting chunk 31 is pivoted to the plate member 13 of the base 10 and pivotable about an axis parallel to the pivot portion 11. The abutting chunk 31 is detachably pivoted to the plate member 13 of the base 10 via a pin 33. As a result, during the bending of the tube 50, the abutting chunk 31 is self-adjustable to make the preferable the second arched groove 311 and the first arched groove 23 in preferable relative positions, so that the resistance to bend the tube 50 is largely reduced and it will not damage the tube 50. Preferably, the abutting assembly 30 is further provided with an indication portion 34 correspondable to the angle reference portion 26. More specifically, the indication portion 34 is a window formed on the arm member 32, with which the degrees of bending angle of the tube 50 can be seen through the window. It is noted that a side of the arm member 32 may serve as the indication portion 34, or the indication portion 34 may be a marking lines or arrow symbol on the arm member 32, which can cooperate with the angle reference portion 26 to provide indication of the degrees of bending angle of the tube 50.

The gear assembly 40 includes a driving portion 41 for being driven by a driving tool and a gear 42 connected and synchronously-movable with the driving portion 41. The driving portion 41 is pivoted to the arm member 32, and the gear 42 and the gear portion 22 are engaged with each other within the inner space 21. Specifically, the driving portion 41 includes a drive head 411 protrusive from the arm member 32 and a middle portion 412 extending from the drive head 411. The gear 42 and the middle portion 412 are connected with each other and synchronously-movable. More specifically, the middle portion 412 is disposed sequentially through the arm member 32 and the gear 42, and an end of the middle portion 412 is detachably and rotatably assembled to the plate member 13, so that the gear 42 can be replaced according to requirements such as bending force for the tube 50 to be bent, replacing of a damaged gear. A gear ratio of the gear 42 to the gear portion 22 gear ratio is not greater than 1 to 4, and preferably 1 to 6, thus providing times of bending force, saving efforts and having good production efficiency.

Figure 4:
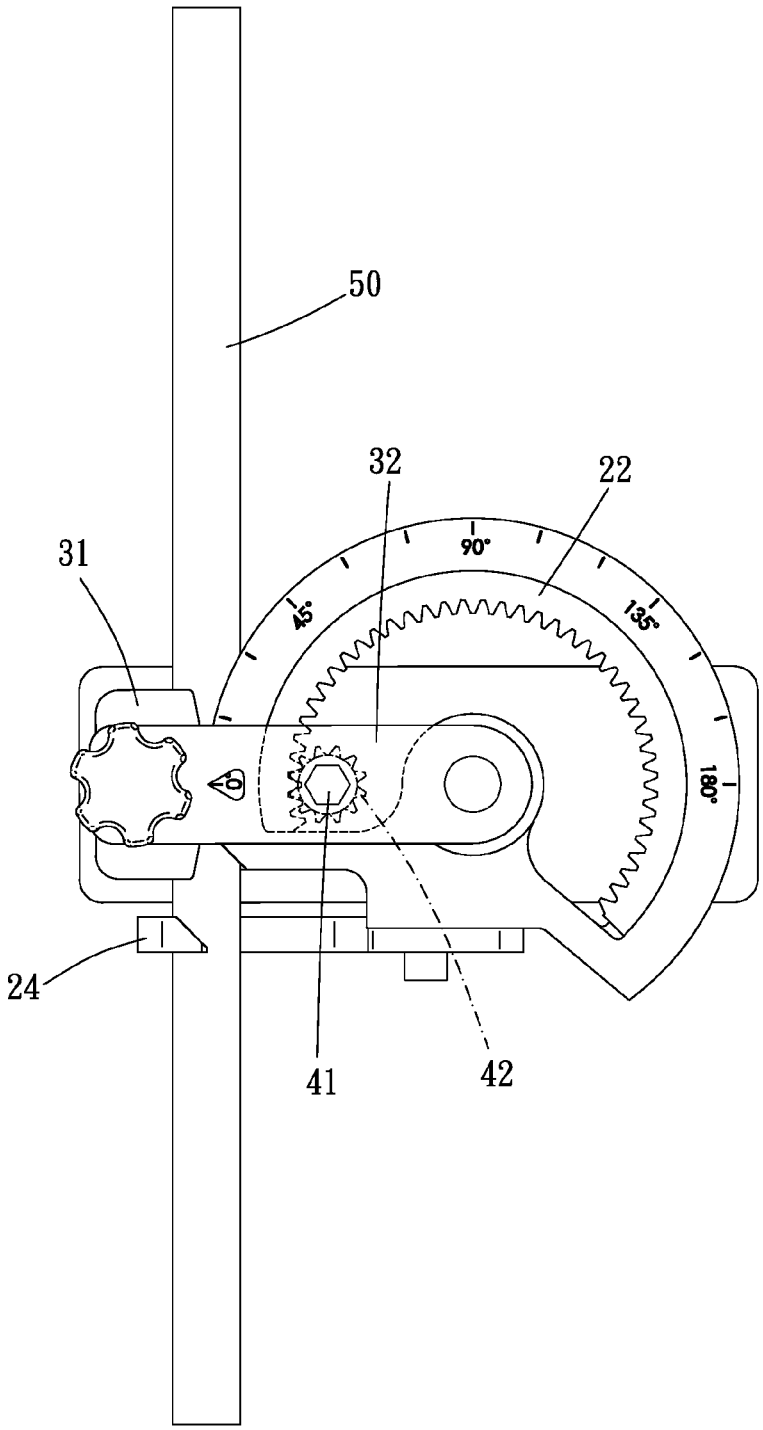
FIGS. 4-6 are drawings showing a tube bender in use according to a preferred embodiment of the present invention.
Figure 5:
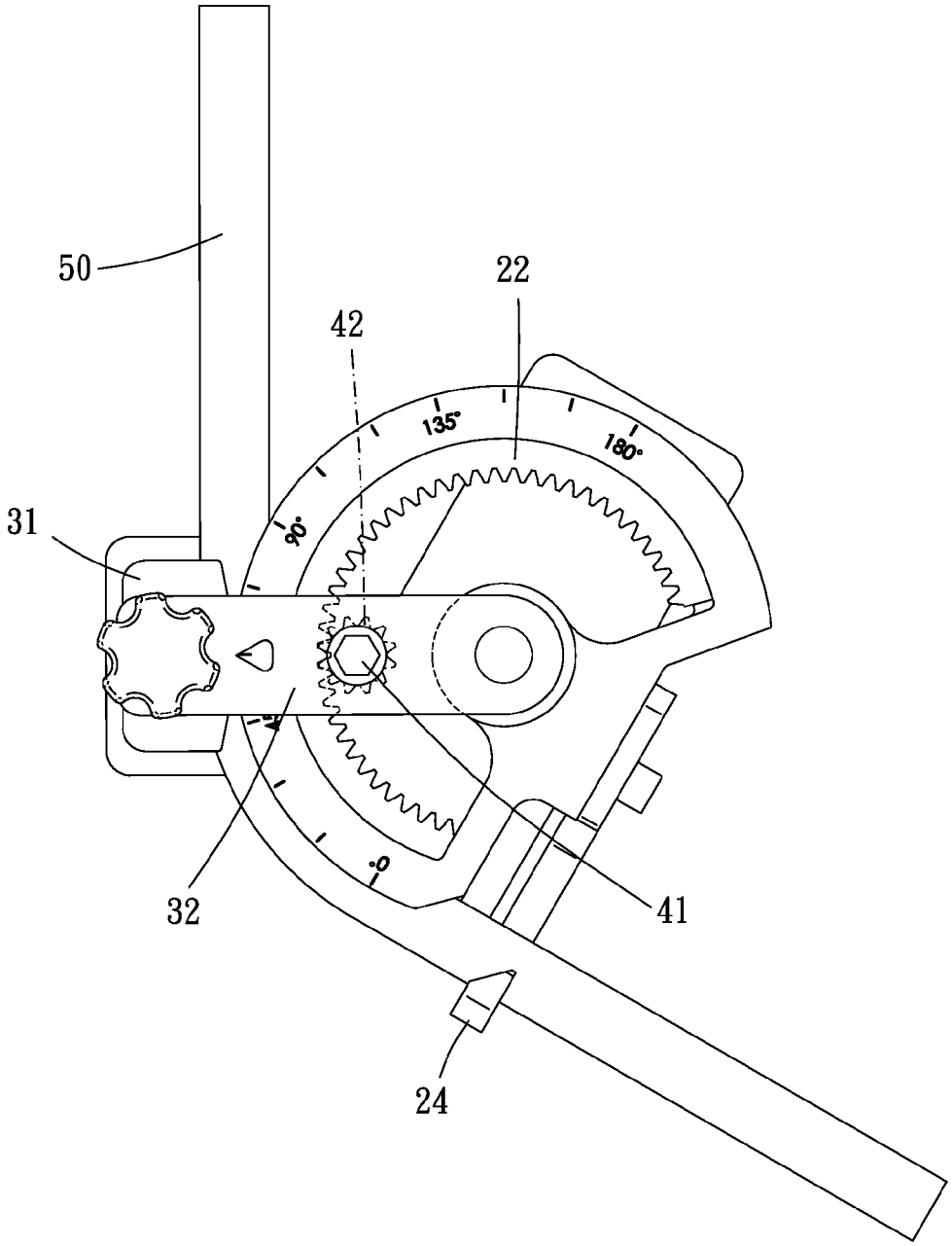
Figure 6:
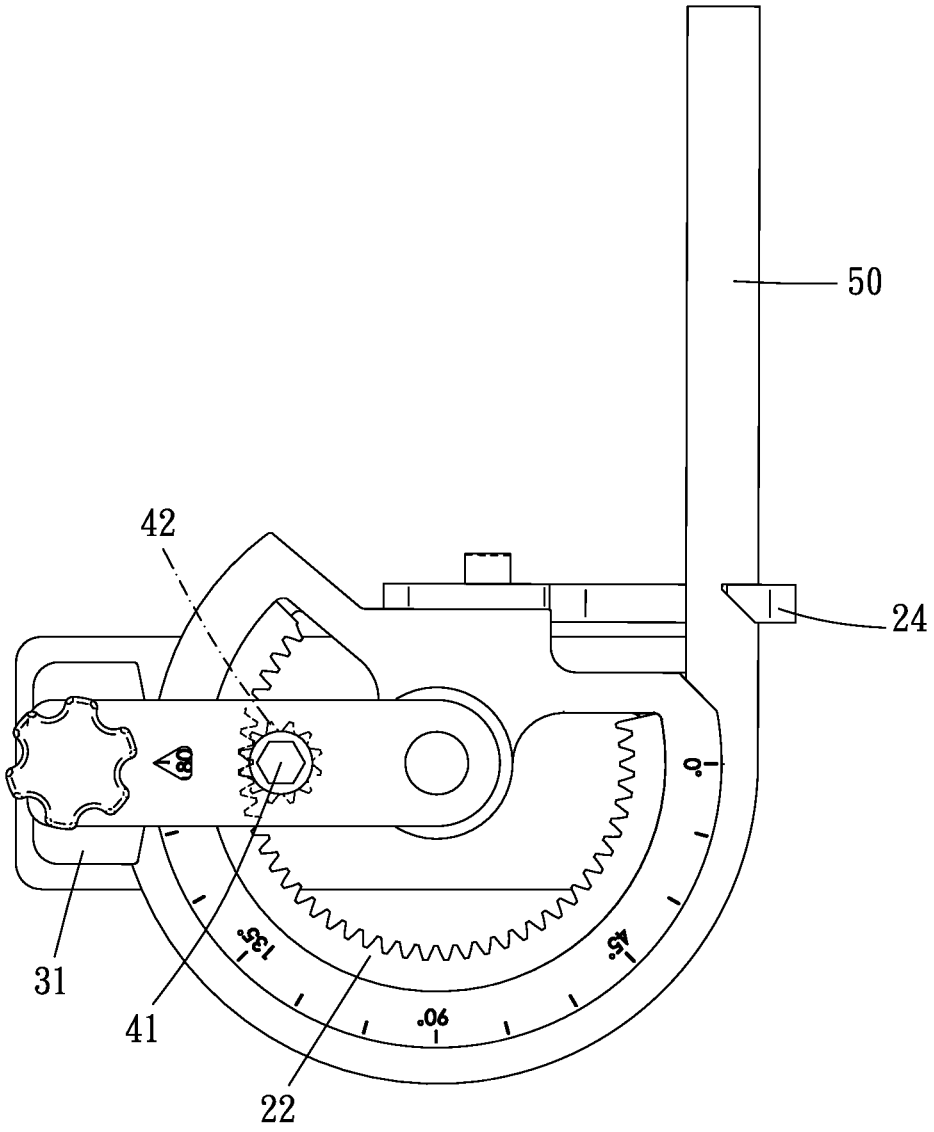

Further, as shown in FIGS. 4-6, during the bending of a tube, the indication portion 34 is set to align with a position marked with "0" of the angle reference portion 26, and the tube 50 is inserted between the holding recess 241 of the holding portion 24 and the first arched groove 23 of the rotatable member 20. A driving tool such as ratchet wrench is used to drive the drive head 411 to drive the gear 42, and the gear 42 drives the gear portion to rotate the rotatable member 20. At the same time, the tube 50 is gradually bent via the relative movement of the abutting chunk 31 and the rotatable member 20 till the tube 50 is bent to be with a predetermined bending degrees. Since the gear ratio of the gear 42 to the gear portion 22 is not greater than 1 to 4, thus providing times of bending force, saving efforts and having good production efficiency.

Given the above, in the tube bender of the present invention, through the cooperation that the gear and the gear portion are engaged with each other within the inner space of the rotatable member, it can provide times of bending force and save efforts. Additionally, the tube bender is simple in structure, easy to manufacture and assemble and of low production cost.

Furthermore, the gear portion, the holding portion and the driving portion may be designed to be detachably assembled and can be replaced according to requirements, so that it has good compatibility and applicability, and it needs only to replace a single damaged part but not the whole of the tube bender, thus being convenient and economical.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tube bender, including:

a base, having a pivot portion;

a rotatable member, pivoted to the pivot portion, defining an inner space, having a gear portion, a first arched groove and a holding portion, the gear portion archedly extending around the pivot portion and located within the inner space, the first arched groove archedly extending around the pivot portion on an outer circumferential surface of the rotatable member, the holding portion having a holding recess, as viewed in a radial direction of the rotatable member, an outmost radial position of the holding recess extending beyond an outmost radial position of the first arched groove;

an abutting assembly, including an abutting chunk assembled to the base, and an arm member connected with the abutting chunk; and a gear assembly, including a driving portion for being driven by a driving tool, and including a gear connected and synchronously-movable with the driving portion, the driving portion pivoted to the arm member, the gear engaged with the gear portion in the inner space;

wherein the arm member is disposed between the gear portion and the driving portion, the driving portion is located outside an outer surface of the arm member away from the gear portion, and the driving portion is for being detachably assembled with and driven by the driving tool from an outside of the tube bender;

wherein the rotatable member further includes a main body which defines the inner space, and the holding portion is detachably fixed to an outer surface of the main body by a side opposite to the gear portion.

2. The tube bender of claim 1, wherein the main body includes a stepped structure formed annularly around the inner space, and the gear portion is detachably assembled to a bottom surface of the stepped structure facing the arm member.

3. The tube bender of claim 1, wherein the rotatable member is further provided with an angle reference portion, and the abutting assembly is further provided with an indication portion corresponding to the angle reference portion.

4. The tube bender of claim 1, wherein as viewed in the radial direction of the rotatable member, the holding recess and the first arched groove form a holding aperture.

5. The tube bender of claim 1, wherein the abutting chunk has a second arched groove corresponding to the first arched groove, and the second arched groove and the first arched groove oppositely extend.

6. The tube bender of claim 1, wherein the abutting chunk is pivoted to the base and pivotable about an axis parallel to the pivot portion.

7. The tube bender of claim 1, wherein the abutting chunk is detachably assembled with the base.

8. The tube bender of claim 1, wherein the arm member is connected with the pivot portion and the abutting chunk.

9. The tube bender of claim 1, wherein the driving portion includes a drive head protrusive from the arm member and a middle portion extending from the drive head, the drive head is for being detachably assembled with and driven by the driving tool, and the gear and the middle portion are connected with each other and synchronously-movable.

10. The tube bender of claim 9, wherein the middle portion is disposed sequentially through the arm member and the gear.

11. The tube bender of claim 1, wherein a gear ratio of the gear to the gear portion is not greater than 1 to 4.

* * * * *